US005924643A

United States Patent [19]

Campana

[11] Patent Number: 5,924,643

[45] Date of Patent: Jul. 20, 1999

[54] CONSTRUCTION LINE HOLDER

[76] Inventor: Vincent Campana, 1520 Lafayette Pkwy., Williamport, Pa. 17701

[21] Appl. No.: 09/076,035

[22] Filed: May 12, 1998

[51] Int. Cl.[6] ..... B65H 75/38

[52] U.S. Cl. ..... 242/405.1; 242/580; 242/604.1; 242/613.3; 33/393

[58] Field of Search ..... 242/405.1, 402, 242/580, 604.1, 613.3; D8/360.1; 33/393

[56] References Cited

U.S. PATENT DOCUMENTS

| | | |
|---|---|---|
| 109,318 | 11/1870 | Holman . |
| D. 275,729 | 10/1984 | Stoddard . |
| 542,564 | 4/1895 | Koerner . |
| 1,178,056 | 4/1916 | Craig . |
| 1,275,735 | 8/1918 | Phillips . |
| 1,454,050 | 5/1923 | Gruenhagen . |
| 1,579,886 | 4/1926 | Oxner . |
| 2,165,021 | 7/1939 | Zink . |
| 2,465,001 | 3/1949 | Walker . |
| 2,472,300 | 6/1949 | Kemplin . |
| 2,481,753 | 9/1949 | Johnson . |
| 2,532,394 | 12/1950 | D'Amico . |
| 2,626,762 | 1/1953 | Zick . |
| 3,885,752 | 5/1975 | Noffsinger . |
| 3,901,458 | 8/1975 | Kuncz, Jr. . |
| 3,934,838 | 1/1976 | D'Amico . |
| 4,285,477 | 8/1981 | Oxendahl et al. . |
| 4,321,755 | 3/1982 | Illgen . |
| 4,779,816 | 10/1988 | Varlet . |

*Primary Examiner*—Donald P. Walsh
*Assistant Examiner*—William A. Rivera
*Attorney, Agent, or Firm*—Wenderoth, Lind & Ponack, L.L.P.

[57] ABSTRACT

A light weight construction line holder having an elongated shaft which terminates at each end in a spiral configuration or coil. The shaft is provided with a through hole for securing an inner end of a construction line. The construction line is wrapped on the shaft and may be tied off at any point along the length thereof by inserting the line into one of the coils and pulling the line under and around the free end of the coil. The line holder is preferably formed of a continuous length of a cylindrical metal rod and is provided with a rustproof coating.

7 Claims, 5 Drawing Sheets

CONSTRUCTION LINE HOLDER

BACKGROUND OF THE INVENTION

1. Field of the Invention

This invention relates to a device for storing construction line, cord, rope or the like thereon in such a manner that a necessary length of the line may be easily removed during use and easily returned for storage thereon. In particular, the device also includes means for restraining the unused portion of the line on the device during use and during storage.

2. Description of the Prior Art

Construction workers, including carpenters, masonry workers, steel workers and the like are frequently required to use long lengths of heavy braided string, hereinafter referred to as construction line. The construction lines are utilized for numerous layout and alignment tasks which must be performed by the construction workers. In use, the construction line is pulled tightly between various points in order to establish a straight line. The straight line is necessary to properly align various structural members or elements during the coarse of a construction project. Further, the construction worker frequently needs to utilize a construction line while working at dangerous heights and under other dangerous working conditions. Therefore, it is important that the construction line can be easily and reliably secured on the holder.

In actual practice, most experienced bricklayers and carpenters wrap or store their construction line on a piece of wood or a dowel. The piece of wood or dowel may be comfortably held in the worker's hand while the line is wrapped thereon with the other hand. The piece of wood or dowel is generally 6 to 8 inches in length and has no obstructions or projecting portions which might hinder the unwrapping or wrapping of the line thereon. In order to secure the line on the piece of wood or dowel, it is necessary to tie a knot in the body of the line about the piece of wood or dowel.

Further, the natural and comfortable manner in which a mason wraps line onto a stick-like piece of wood, generally follows a figure eight pattern about the holder. To wrap the line in this manner, the piece of wood is held and rotated in the palm of one hand, while the line is wrapped onto the holder with the other hand. This manner of wrapping the line prevents undesirable coiling of the line.

Other devices have been designed which include a notch for securing the line therein. However, over time the notch will generally wear out so that it is no longer effective in preventing unraveling of the line. Therefore, the construction worker generally resorts back to tying a knot around some part of the device. Accordingly, this necessitates the tedious and time consuming task of tying and untying the knot. Also, the constant repetitions of inserting the line in the notch and removing the line therefrom will eventually weaken that portion of the line. As a result, the weakened line, when pulled taught, may break and possibly cause injury by striking the worker at a high velocity.

Another prior art device for storing construction line, includes reel mechanisms, such as that disclosed in U.S. Pat. No. 4,285,477. The reel-type holders are targeted more towards storing longer lengths of line. Also, line reels in the masonry field are particularly susceptible to the problem of accumulating mortar or dirt in the working or moving parts of the holding device. This results in inefficiencies and oftentimes in the device being discarded in favor of the nearest piece of wood. Also, reel-type holders store the line in a coiled fashion, which is more likely to result in the line becoming tangled and generally more difficult to straighten. This presents a problem because of the precision which is required in the alignment function.

The prior art devices are somewhat complex and often are of a size which is not be easily accommodated in a worker's tool box.

Accordingly, it is clear that there is a need for a construction line holder which is inexpensive, easy to use, reliable, and can be easily accommodated in a worker's tool box.

SUMMARY OF THE INVENTION

It is an object of the present invention to provide a holder for relatively short lengths, i.e. 50 to 100 feet, of construction line which is simple in design and easy to use. A further object of the invention is to provide a construction line holder which is durable, rustproof and can reliably secure a construction line thereon during use and during storage.

The present invention provides a construction line holder which allows the line to be quickly removed from the holder and easily wound on the holder in a figure eight manner. For both safety and efficiency reasons it is important that the construction line can be easily deployed from the holding device and easily returned to the holding device following use thereof. The holding device should also be provided with a line securing means which will allow a hitch to be put in the line so as to prevent the line from inadvertently unraveling from the holding device.

In particular, the construction line holder of the present invention is simple in design and is intended to hold 50 to 100 feet of line. The device is also of a sturdy construction in that it is made of one continuous piece of steel and is provided with a rustproof coating. The rustproof coating may be a rubberized coating which may be white or colored.

BRIEF DESCRIPTION OF THE DRAWINGS

The construction line holder constructed in accordance with the present invention is illustrated in the accompanying drawings in which.

DETAILED DESCRIPTION OF THE INVENTION

Figure 1:
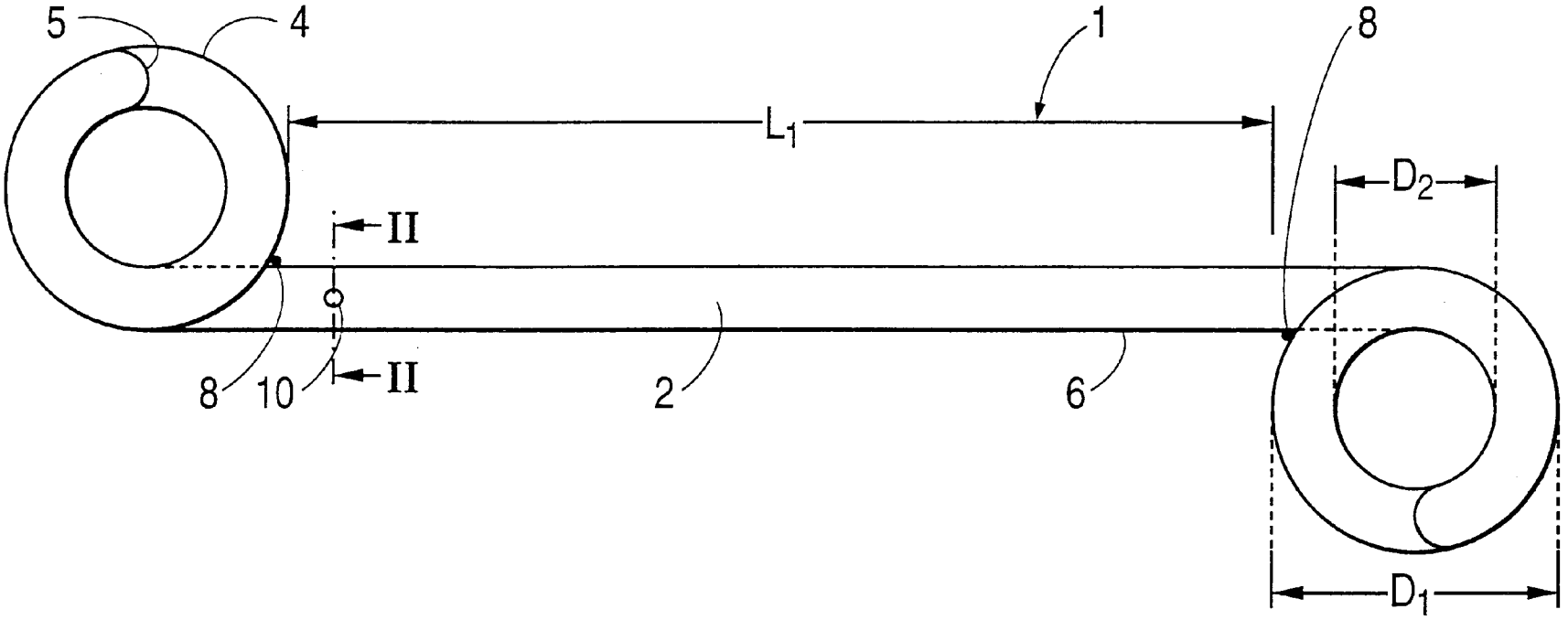
FIG. 1 is a top plan view of a construction line holder of the present invention.

A construction line holder 1 is shown in FIG. 1 and includes a shaft 2 which terminates at each end in a coil 4. Each of the coils 4 is preferably formed by a spiral which extends through 1.5 revolutions and terminates in a free end 5. Blocking structures 8 are provided between each coil 4 and an opposing portion of shaft 2. In the preferred construction of the line holder of the present invention, the blocking structures 8 comprise spot welds which function to prevent a line from being pulled completely through the coil when inserted therein. Due to the blocking structures 8, a secure hitch can be placed in the line.

Further, a through hole 10 is formed in the line holder shaft 2. The through hole 10 is provided for securing or tying an inner end of the construction line to the shaft.

Figure 2:
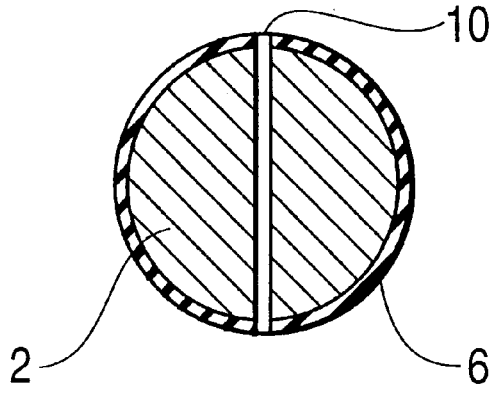
FIG. 2 is a vertical cross-sectional view taken along section line II—II of FIG. 1.

The construction line holder is an integral one piece unit. As can be best seen in FIG. 2, which is a cross-section through the shaft 2, the line holder is preferably formed of a single continuous piece of steel and provided with a rustproof coating 6, such as a rubberized coating. The coating 6 may be white or colored and may also be provided with written indicia, such as advertising or other information. However, it should be noted that the construction line holder could also be formed of other materials such as a hard durable plastic.

Preferably, the shaft should be of a length $L_1$, of approximately 4 inches. Note that this length should be sufficient to enable a worker to comfortably grasp the construction line holder and to permit a sufficient length of construction line to be wrapped thereon. The diameter of the shaft should preferably be approximately 0.25 inches in diameter and the coils are preferably formed with an outside diameter $D_1$ of approximately 1.125 inches with the inside diameter $D_2$ being approximately 0.625 inches.

Figure 3:
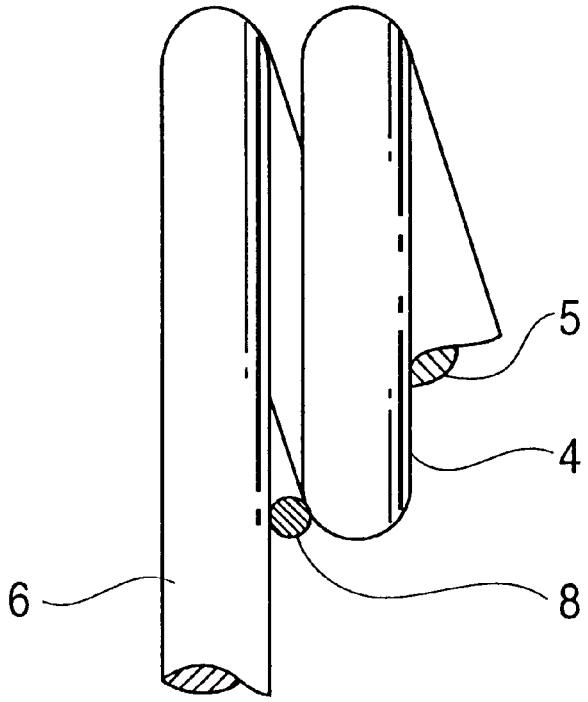
FIG. 3 is a top plan view of one end of the construction line holder shown in FIG. 1.

FIG. 3 shows one of the coils 4 with an exaggerated spacing between the turns of the illustrated coil. In an actual construction of the holder 1, the adjacent turns of the coil 4 are spaced by an amount which is sufficient to permit a braided construction line to easily pass through the space. As indicated above, the line will be restricted from passing completely through the space by the blocking structure 8, such as a spot weld.

Figure 4:
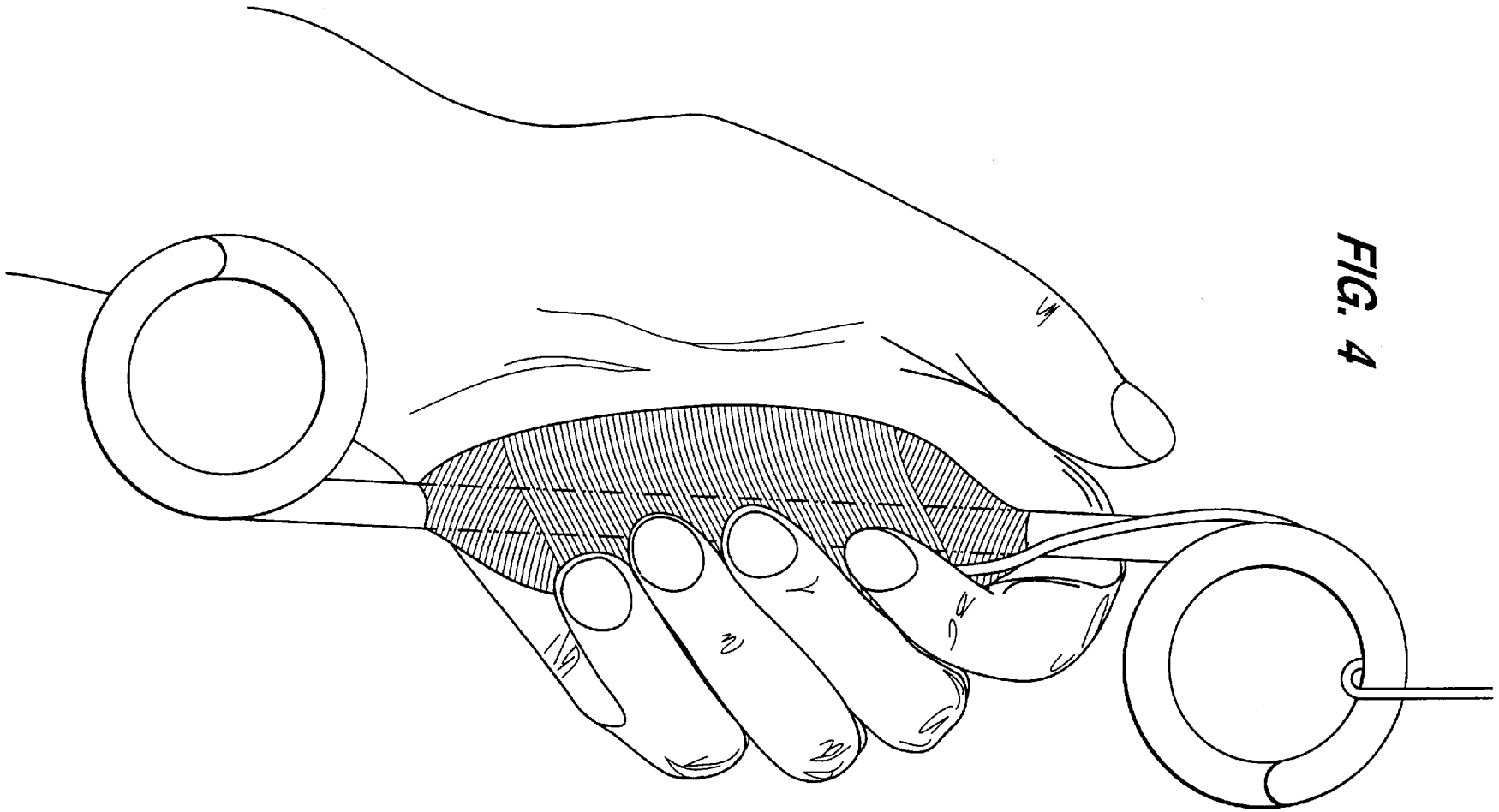
FIG. 4 is a perspective view of the construction line holder of FIG. 1 as it is held in the hand of a user.

As can be seen from the above description, the overall size of the construction line holder will permit it to be easily stored in tool boxes or tool bags. The size of the construction line holder also facilitates wrapping of the construction line on the line holder. The wrapping of the line is initially accomplished by inserting one end of the construction line in through hole 10 and tying this end so that it is secured at the through hole 10. The construction line holder is then held in one hand of a worker, as shown in FIG. 4, and the line is wrapped on the line holder shaft 2 with the other hand. The line is wrapped on the shaft in a figure eight pattern as the worker rotates the line holder shaft 2 in the palm of his hand while continuously wrapping the line on the shaft. By wrapping the line on the holder in this fashion, it is much less likely to become tangled and can easily be straightened when unwound.

Figure 5:
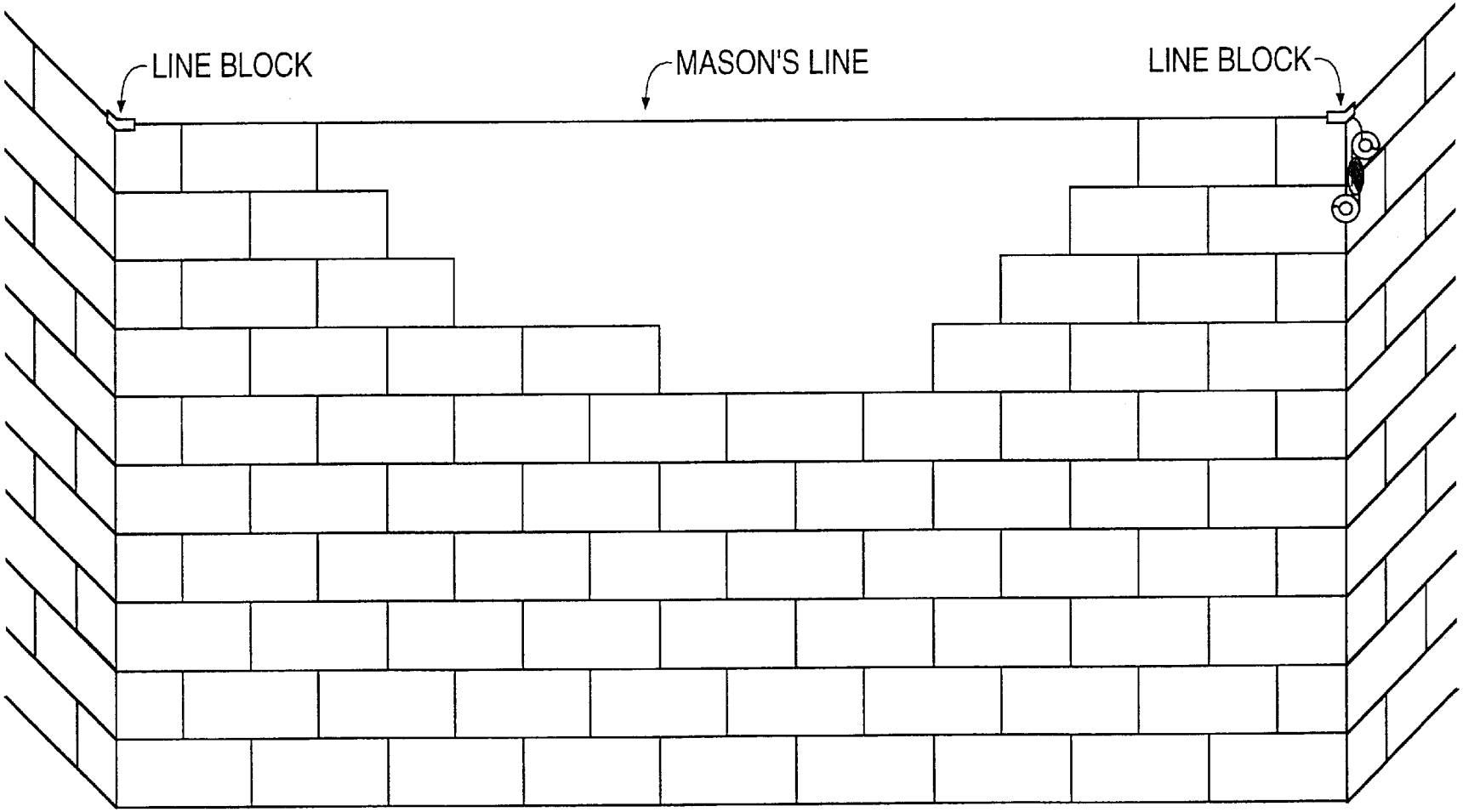
FIG. 5 is a perspective view of the construction line holder while the line is in use.
Figure 6:
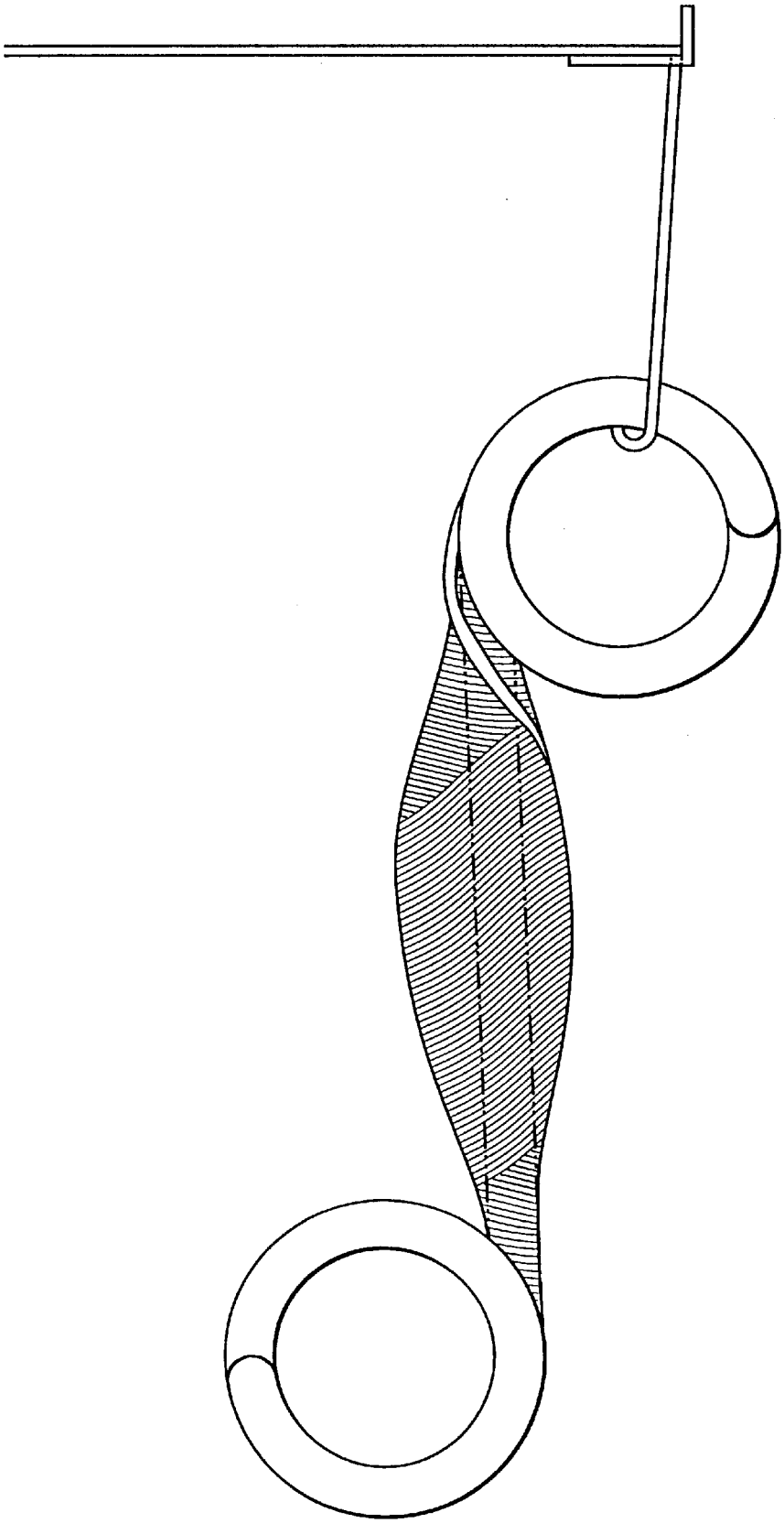
FIG. 6 is an enlarged view of the construction line holder shown in FIG. 4.

FIGS. 5–6 show the line holder in use. As can be seen from FIG. 5, a straight line is formed by tying off the construction line at two points on a construction project with the use of line blocks which are well known in the masonry art.

After the line is secured to the second construction block, a hitch is placed in the line. This is achieved by inserting the line through the space between adjacent turns of one of the coils 4. The line engages the spot weld 8 and is thereby prevented from being pulled completely through the coil. As the line is moved through the space, it is pulled under the coil free end 5 so that it engages an inner peripheral portion of the coil, as best shown in FIG. 6. The line holder, with the excess line wrapped thereon, can then be suspended from the second line block as shown in FIGS. 5–6. Due to the novel line securing arrangement, unraveling of the excess line from the line holder is reliably prevented. The ease with which the line is secured or prevented from unraveling is important because the construction line will likely be moved several times during the coarse of a work day, thereby requiring that the above process be repeated several times.

Certain modifications to the construction line holder of the present invention, as described and illustrated above, will be apparent to those skilled in the art and such changes may be made in form and detail without departing from the spirit and scope of the present invention.

What is claimed is:

1. A construction line holder comprising:

an elongated shaft having a first end and a second end;

a first coil extending from said first end of said shaft;

a second coil extending from said second end of said shaft, wherein each of said first and second coils terminates in a free end;

a first line blocking structure provided between opposing portions of said shaft and said first coil in order to prevent a line from passing between said opposing portions of said shaft and said first coil; and a second line blocking structure provided between opposing portions of said shaft and said second coil in order to prevent a line from passing between said opposing portions of said shaft and said first coil;

wherein each of said first and second line blocking structures comprises a spot weld.

2. The construction line holder as claimed in claim 1, further comprising a through hole formed in said shaft, wherein said through hole is for securing one end of a construction line.

3. The construction line holder as claimed in claim 2, wherein said shaft, said first coil and said second coil are formed of a single cylindrical metal rod.

4. The construction line holder as claimed in claim 3, wherein each of said first and second coil is comprised of approximately 1.5 rotations of said cylindrical metal rod.

5. The construction line holder as claimed in claim 3, wherein said cylindrical metal rod is provided with a rust proof coating.

6. A combination of a construction line holder and a construction line comprising:

an elongated shaft having a first end, a second end and a through hole disposed between said first and second ends;

a first coil extending from said first end of said shaft;

a second coil extending from said second end of said shaft, wherein each of said first and second coils terminates in a free end;

a first spot weld provided between opposing outer peripheral surfaces of said shaft and said first coil in order to prevent a line from passing between said opposing surfaces of said shaft and said first coil; and a second spot weld provided between opposing outer peripheral surfaces of said shaft and said second coil in order to prevent a line from passing between said opposing portions of said shaft and said first coil, wherein said construction line is a braided construction line having a first end secured in said through hole, said construction line being wrapped on said elongated shaft in a figure eight pattern.

7. The combination as claimed in claim 6, wherein said shaft, said first coil and said second coil are formed of a single cylindrical metal rod, and each of said first and second coils is formed by bending opposite ends of said cylindrical metal rod through approximately 1.5 revolutions.

* * * * *